US011611148B2

(12) United States Patent
Wong et al.

(10) Patent No.: US 11,611,148 B2
(45) Date of Patent: Mar. 21, 2023

(54) OPEN-APERTURE WAVEGUIDE FED SLOT ANTENNA

(71) Applicant: City University of Hong Kong, Hong Kong (HK)

(72) Inventors: Hang Wong, Hong Kong (HK); Qingyi Guo, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 17/527,077

(22) Filed: Nov. 15, 2021

(65) Prior Publication Data

US 2022/0209417 A1 Jun. 30, 2022

Related U.S. Application Data

(60) Provisional application No. 63/130,547, filed on Dec. 24, 2020.

(51) Int. Cl.
*H01Q 13/18* (2006.01)
*H01Q 13/22* (2006.01)
*H01Q 13/10* (2006.01)

(52) U.S. Cl.
CPC ..... *H01Q 13/18* (2013.01); *H01Q 13/106* (2013.01); *H01Q 13/22* (2013.01)

(58) Field of Classification Search
CPC ..... H01Q 13/18; H01Q 13/22; H01Q 13/16; H01Q 13/106
See application file for complete search history.

(56) References Cited

U.S. PATENT DOCUMENTS 5,541,612 A 7/1996 Josefsson
5,638,079 A 6/1997 Kastner et al.
(Continued)

FOREIGN PATENT DOCUMENTS

CN 110323526 A * 10/2019
EP 0440126 A1 8/1991
JP 2018182742 A * 11/2018 ..... G01S 13/931

OTHER PUBLICATIONS

P. N. Choubey, W. Hong, Z. Hao, P. Chen, T. Duong and J. Mei, "A wideband dual-mode SIW cavity-backed triangular-complimentary-split-ring-slot (TCSRS) antenna" in IEEE Transactions on Antennas and Propagation, vol. 64, No. 6, pp. 2541-2545, Jun. 2016.
(Continued)

*Primary Examiner* — Ab Salam Alkassim, Jr.
*Assistant Examiner* — Anh N Ho
(74) *Attorney, Agent, or Firm* — Idea Intellectual Limited; Margaret A. Burke; Sam T. Yip

(57) ABSTRACT

The present invention provides an open-aperture waveguide fed slot antenna including a feeding section on a substrate integrated waveguide, an H-shaped slot, a matched end, and a bottom metal layer. One end of the feeding section is open and connected to the slot, providing energy feeding to the slot. A long side of the center section of the slot is connected to a top metal part of the feeding section. Another side is connected to the matching end. The matching end includes metal which is connected to the slot, the metallic via wall and the bottom metal of the feeding section which is connected to the metallic via wall. The antenna has high gain, wide gain bandwidth, a simple structure, and low processing cost and can be applied to millimeter-wave frequency bands as well as other frequency bands.

9 Claims, 9 Drawing Sheets

(56) References Cited

U.S. PATENT DOCUMENTS

| | | | | |
|---|---|---|---|---|
| 5,831,583 | A | 11/1998 | Lagerstedt et al. | |
| 10,522,919 | B2 * | 12/2019 | Pucci | H01Q 1/521 |
| 10,686,254 | B2 * | 6/2020 | Cai | H01Q 21/0075 |
| 10,763,590 | B2 * | 9/2020 | Kirino | H01Q 21/06 |
| 2009/0066597 | A1 | 3/2009 | Yang et al. | |
| 2012/0092224 | A1 * | 4/2012 | Sauleau | H01Q 21/005 343/771 |
| 2015/0222023 | A1 * | 8/2015 | Shijo | G01S 13/4463 342/195 |
| 2020/0014118 | A1 * | 1/2020 | Wong | H01Q 21/064 |

OTHER PUBLICATIONS

Y. Liu, H. Liu, M. Wei and S. Gong, "A Novel Slot Yagi-Like multilayered antenna with high gain and large bandwidth" in IEEE Antennas and Wireless Propagation Letters, vol. 13, pp. 790-793, 2014.

S. Pandit, A. Mohan and P. Ray, "A low-profile high-gain substrate-integrated waveguide-slot antenna with suppressed cross polarization using metamaterial" in IEEE Antennas and Wireless Propagation Letters, vol. 16, pp. 1614-1617, 2017.

Y. Zhao, X. Cao, J. Gao, X. Yao and X. Liu, "A Low-RCS and High-Gain Slot Antenna Using Broadband Metasurface" in IEEE Antennas and Wireless Propagation Letters, vol. 15, pp. 290-293, 2016.

M. van Rooyen, J. W. Odendaal and J. Joubert, "High-Gain Directional Antenna for WLAN and WiMAX Applications" in IEEE Antennas and Wireless Propagation Letters, vol. 16, pp. 286-289, 2017.

Li Yan, Wei Hong, Guang Hua, Jixin Chen, Ke Wu and Tie Jun Cui, "Simulation and experiment on SIW slot array antennas," IEEE Microwave and Wireless Components Letters, vol. 14, No. 9, pp. 446-448, Sep. 2004.

Z. H. Jiang, Q. Wu, D. E. Brocker, P. E. Sieber and D. H. Werner, "A Low-Profile High-Gain Substrate-Integrated Waveguide Slot Antenna Enabled by an Ultrathin Anisotropic Zero-Index Metamaterial Coating" in IEEE Transactions on Antennas and Propagation, vol. 62, No. 3, pp. 1173-1184, Mar. 2014, doi: 10.1109/TAP.2013.2294354.

Y. Wu, Z. Hao, Z. Miao, W. Hong and J. Hong, "A 140 GHz High-Efficiency Slotted Waveguide Antenna Using a Low-Loss Feeding Network," in IEEE Antennas and Wireless Propagation Letters, vol. 19, No. 1, pp. 94-98, Jan. 2020, doi: 10.1109/LAWP.2019.2954138.

T. Quinlan and S. Walker, "A Coaxial, 60-GHz, 15.3-dBi Slot Antenna Array" in IEEE Antennas and Wireless Propagation Letters, vol. 13, pp. 818-821, 2014.

W. Han, F. Yang, J. Ouyang and P. Yang, "Low-Cost Wideband and High-Gain Slotted Cavity Antenna Using High-Order Modes for Millimeter-Wave Application" in IEEE Transactions on Antennas and Propagation, vol. 63, No. 11, pp. 4624-4631, Nov. 2015.

P. Liu, J. Liu, W. Hu and X. Chen, "Hollow Waveguide 32 × 32-Slot Array Antenna Covering 71-86 GHz Band by the Technology of a Polyetherimide Fabrication" in IEEE Antennas and Wireless Propagation Letters, vol. 17, No. 9, pp. 1635-1638, Sep. 2018, doi: 10.1109/LAWP.2018.2859582.

Y. Li and K. M. Luk, "Low-Cost High-Gain and Broadband Substrate- Integrated-Waveguide—Fed Patch Antenna Array for 60-GHz Band" IEEE Transactions on Antennas and Propagation, vol. 62, No. 11, pp. 5531-5538, Nov. 2014.

Q. Zhu, K. B. Ng, C. H. Chan and K. M. Luk, "Substrate-Integrated-Waveguide—Fed Array Antenna Covering 57-71 GHz Band for 5G Applications" IEEE Transactions on Antennas and Propagation, vol. 65, No. 12, pp. 6298-6306, Dec. 2017.

* cited by examiner

OPEN-APERTURE WAVEGUIDE FED SLOT ANTENNA

TECHNICAL FIELD:

The present invention relates the field of radiating components as well as antennas in the field of radio frequency communication, imaging, radar, sensing, detection, or medical applications, and, more particularly to an open-aperture waveguide fed slot antenna.

BACKGROUND:

Since the establishment of large-scale mobile communications in the 1980s, mobile networks have become the basic information network connecting human society. With the rapid development of information and network technologies, mobile communication has also evolved towards requiring substantially higher rates of data transmission. Hence, the millimeter wave frequency band has attracted increasing research and development efforts. As the interface between the medium of communication and transmitting/receiving electronic equipment, the performance of the antenna becomes an important factor affecting the performance of the entire wireless system. In the millimeter wave frequency band, a high-gain antenna can overcome the signal attenuation problem in millimeter wave communications; improving antenna gain is beneficial to improve the millimeter wave communication quality and communication distance. In addition, designing high-gain antenna elements while maintaining the simplicity of the antenna structure itself has become increasingly important. This is because a simple antenna structure is beneficial to streamline antenna fabrication and reduce costs, especially in the millimeter wave frequency band.

As a simple radiation structure, a waveguide slot antenna is widely used. Its low profile and low complexity make it applicable in large-scale arrays. With the maturity of dielectric SIW technology, traditional printed circuit board technology can be used to produce millimeter wave waveguide structures, and waveguide slot antenna designs have become more mature and widely developed in the millimeter wave spectrum.

However, due to the limitation of its radiation aperture, traditional slot antennas often suffer from low radiation gain. In order to achieve high antenna gain, existing designs are based on multiple PCB layers or bulky and complicated structures, which are high-cost and cannot be readily scaled to the millimeter-wave band.

Thus, there is a need in the art for improved slot-based antennas that have both high gain and a wide gain bandwidth. Such antennas may be used in a variety of applications, including millimeter-wave communication systems.

SUMMARY:

The present invention provides an open-aperture waveguide fed slot antenna including a feeding section based on a substrate integrated waveguide (SIW), a slot, a matched end, and a bottom metal layer. The length of the feeding section based on the SIW can be arbitrary. One end of the feeding section is opened and connected to the slot, providing energy feeding to the slot. The slot is an "H" shaped structure. A long side of the center section of the slot is connected to the top metal part of the feeding section. Another side is connected to the matching end. The two short sides of the slot do not connect to metal. The two end sections of the "H" shaped slot have a larger width. Three edges of each end section with larger width are connected to the top metal of the feeding section. The substrate within the "H" shaped region from the top to the bottom of feeding section is removed, which means the slot may be filled by air or another dielectric material. The bottom metal of the antenna is a square-shaped structure, which is the longitudinal and lateral extension of the bottom of feeding section. The matching end includes the metal which is connected to the slot, the metallic via wall and the bottom metal of the feeding section which is connected to the metallic via wall.

In one aspect, the present invention provides an antenna having a feeding section defined on a substrate integrated waveguide, wherein the feeding section includes a slot structure filled with a material different from that of the substrate integrated waveguide. A matching end is positioned adjacent to the slot structure. A bottom metal sheet disposed on a bottom surface of the substrate integrated waveguide.

BRIEF DESCRIPTION OF THE DRAWINGS

Some embodiments of the invention will now be described by way of example and with reference to the accompanying drawings, in which:

FIG. 1*a* is a perspective view, FIG. 1*b* is a top view, FIG. 1*c* is a side view, and FIG. 1*d* is a bottom view of an embodiment of an antenna.

DETAILED DESCRIPTION

Figure 1A:
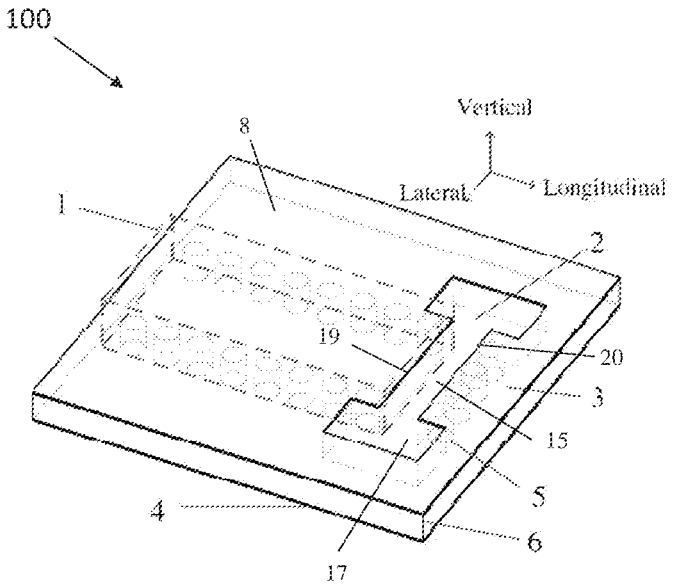
FIGS. 1*a-d* depict a slot antenna structure.
Figure 1B:
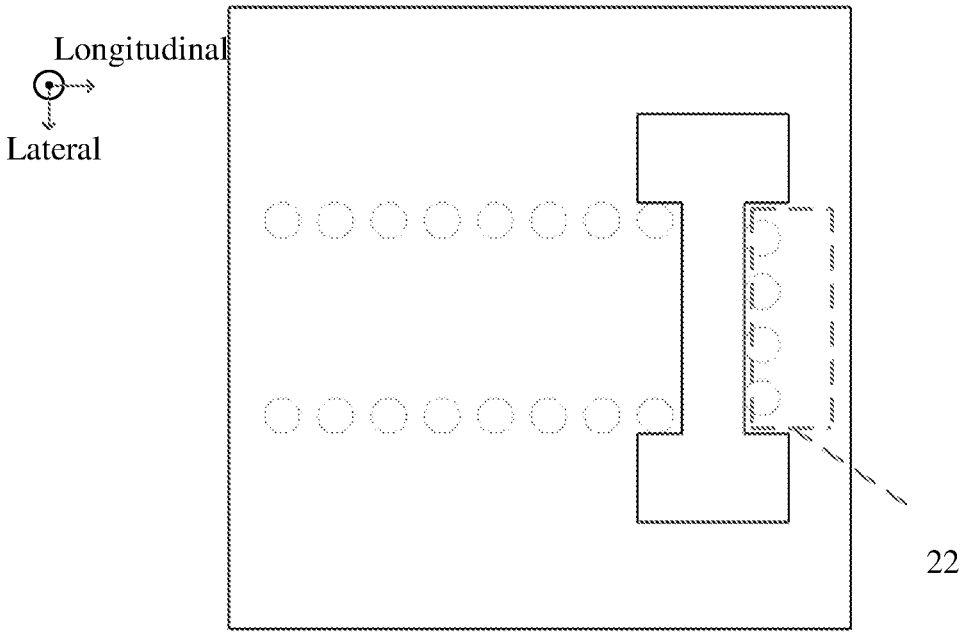
Figure 1C:
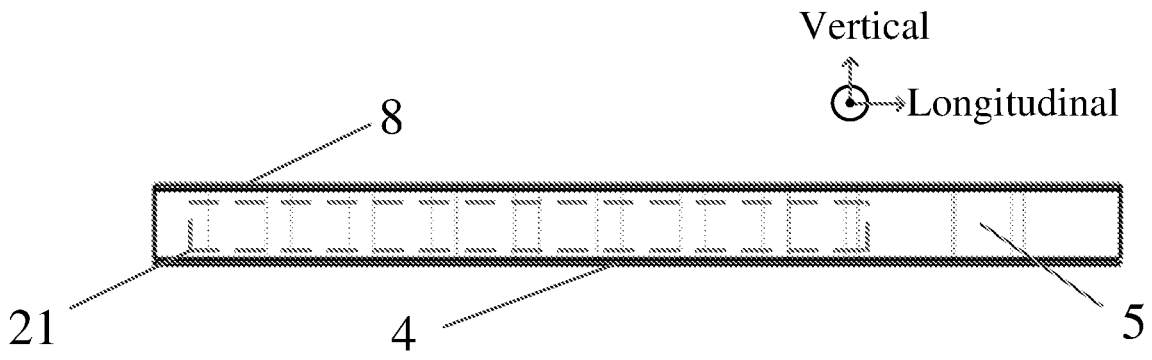
Figure 1D:
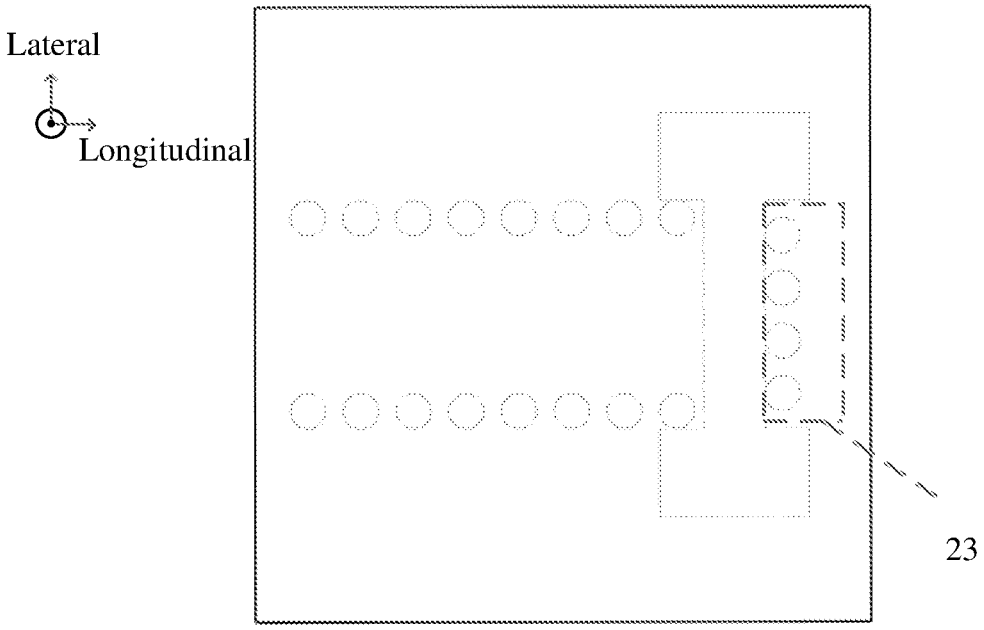

The present invention provides an open-aperture waveguide-fed slot antenna, having both high gain and a wide gain bandwidth while maintaining a simple structure with straightforward fabrication. The proposed antenna differs from traditional slot antennas in that the antenna of the present invention uses an "H"-shaped slot, and uses a dielectric integrated waveguide to feed this slot. The working frequency band can be designed in the traditional microwave frequency band or the millimeter-wave frequency band, and is particularly suitable as an antenna element for a single-layer high-gain linear array in the millimeter wave frequency band.

Turning to the drawings in detail, FIGS. 1*a*-1*d* depict an open-aperture waveguide fed slot antenna 100 including a feeding section 1 based on a substrate integrated waveguide (SIW) formed on a dielectric substrate 6. The antenna includes a slot 2 formed by a recess in substrate 6. The recessed slot 2 may be filled with air or with a dielectric material other than the substrate material. The antenna further includes a matched end 3, and a bottom metal layer 4. The top of the slot 2 and a top metal surface 8 of the feeding section are in the same longitudinal plane. By adjusting the length and width of the slot, compared with a conventional slot antenna, higher gain and wider gain bandwidth can be achieved. When an SIW is used as feeding section 1, an impedance bandwidth ranges from 52 GHz to 90 GHz, the peak gain is 8.7 dBi and the 3-dB gain bandwidth of the antenna is 57.5%; stable unidirectional radiation patterns are also achieved.

The "H"-shaped slot 2 includes a center section 15 and two end sections 17. One of the long sides 19 of the center section 15 connects to a top metal surface of the feeding section 1, another long side 20 connects to the matching end 3; the two short sides do not connect to any metal portions. The two end sections 17 of the "H" shaped slot have larger widths than the center section 15. Three edges of each end section 17 having the larger width are connected to the top metal surface 8 of the feeding section 1. The center section 15 of the "H"-shaped slot 2 and the matching end 3 have the same width in the lateral direction, and are arranged along the longitudinal direction.

The excitation part of the antenna is the part of feeding section 1 away from the "H"-shaped slot 2. A metallic via 5 has the same width as that of the center section 15 of the "H" shaped slot 2 in the longitudinal direction. The height of the metallic via 5 is equal to that of the feeding section 1 in vertical direction. The metallic via 5 the top and bottom metal patch layers 8 and 4 which are connected by the metallic 5 forms the matching end 3. While the metal layers cover the waveguide, the top metal patch region is shown in dashed lines as element 22 in FIG. 1*b*.

The bottom metal layer 4 includes a square metallic patch 23 which covers the bottom part of the antenna, which is the longitudinal and lateral extension of the bottom of feeding section 1.

In an embodiment, the feeding section 1 is formed on dielectric substrate 6; in turn, the entire antenna is formed on a single layer dielectric substrate 6. As such, the antenna may be fabricated using single-layer printed circuit board manufacturing techniques.

The feeding section based on SIW belongs to a waveguide transmission structure; the matching end 3 includes the metallic via 5 and the top and bottom metallic patches which are connected by the metallic via 5. The top metallic patch 8 and the "H"-shaped slot 2 are on the same plane; the bottom metallic patch 4 and the bottom metal of the antenna 4 are on the same longitudinal level. The size and shape of the top metallic patch 22 and bottom metallic patch 23 are exactly the same and they coincide on the same longitudinal level. The inside of the feeding section, shown as dashed lines 21 in FIG. 1*c* can be filled with dielectric material.

EXAMPLE:

An antenna was formed according to the embodiment of FIG. 1 on a Rogers Duroid 5880 dielectric substrate 6 with a thickness of 0.508 mm, a dielectric constant of 2.2 and a loss tangent of 0.002. The width A and the length S of the feeding section 1 is selected as 2.6 mm and 5.1 mm, respectively, which ensures an electromagnetic wave transmission in the feeding section with a TE10 mode. The length L and width W of each end section of the "H" shaped slot are important parameters for achieving high antenna gain. The length L and width W, which are optimized through parameter analysis, are chosen as 1 mm and 1.7 mm, respectively, namely 0.2λ and 0.34λ.

The typical dimensions (in millimeters) of the antenna structure used in FIG. 1 are given below, with a center operating frequency of 70 GHz.

| H | A | S | L |
|---|---|---|---|
| 0.508 | 2.2 | 0.8 | 1 |

The simulation software analyzes the electromagnetic characteristics of the embodiment shown in FIG. 1 based on the principle of the Finite element method. The simulated performance results are presented in FIGS. 2 and 3, respectively.

Figure 2:
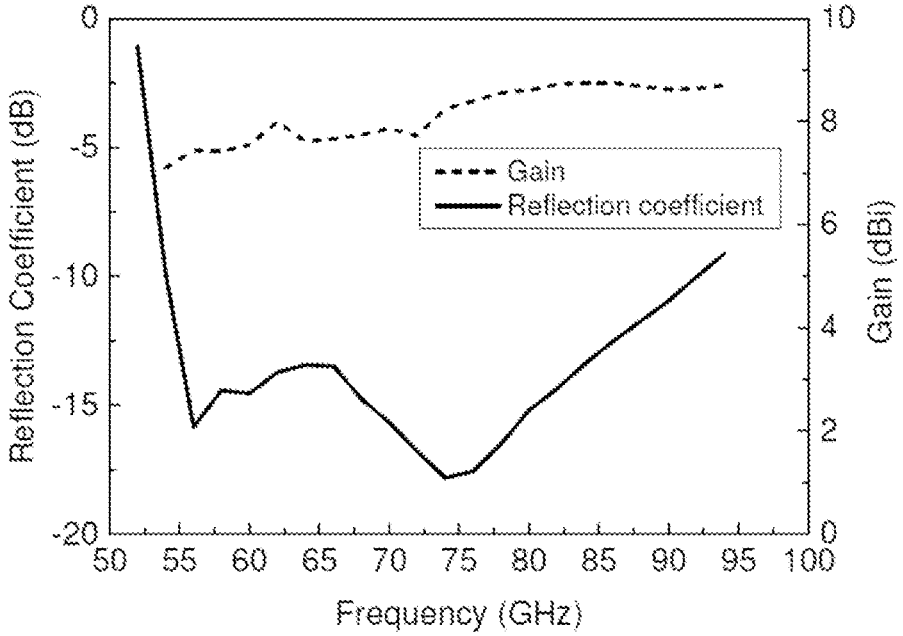
FIG. 2 illustrates simulated realized gain and reflection coefficients versus frequency of the antenna shown in FIG. 1.

FIG. 2 illustrates the simulated reflection coefficient and realized gain versus frequency. It can be seen that the reflection coefficient of the antenna is lower than −10 dB within the frequency range from 52-90 GHz. The peak gain of the antenna is 8.7 dBi within the operating bandwidth whose reflection coefficient <−10 dB. The 3-dB gain bandwidth of the antenna is 57.5%.

Figure 3A:
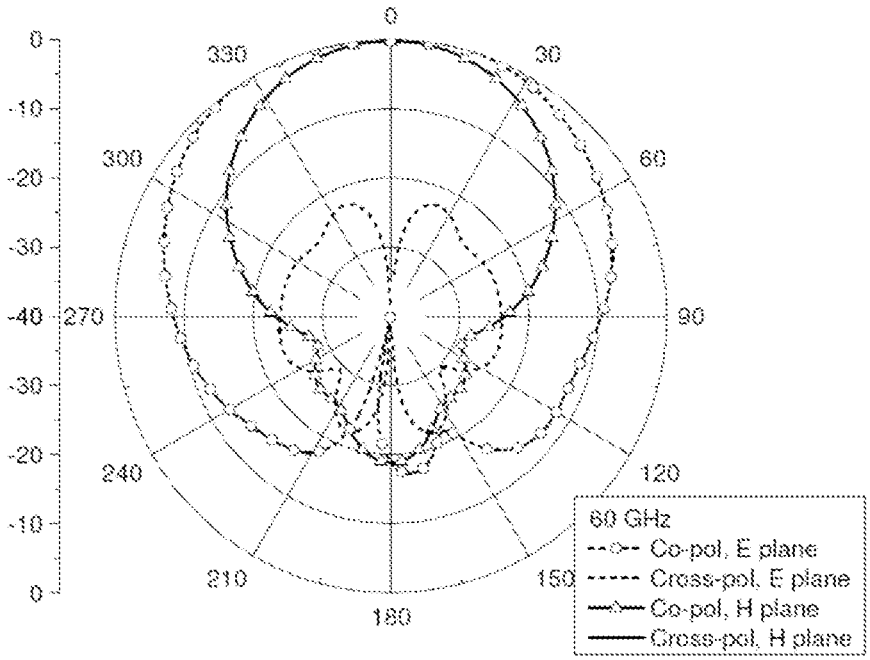
FIGS. 3*a*-3*c* shows simulated radiation patterns for the antenna of FIG. 1 at the frequency point of 60 GHz (FIG. 3*a*), 70 GHz (FIGS. 3*b*), and 80 GHz (FIG. 3*c*).
Figure 3B:
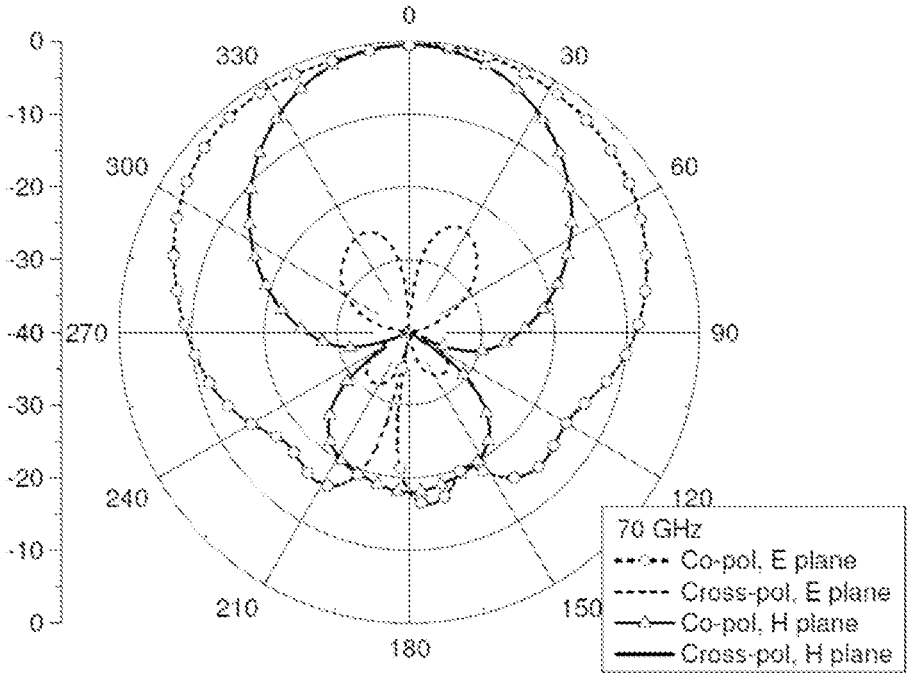
Figure 3C:
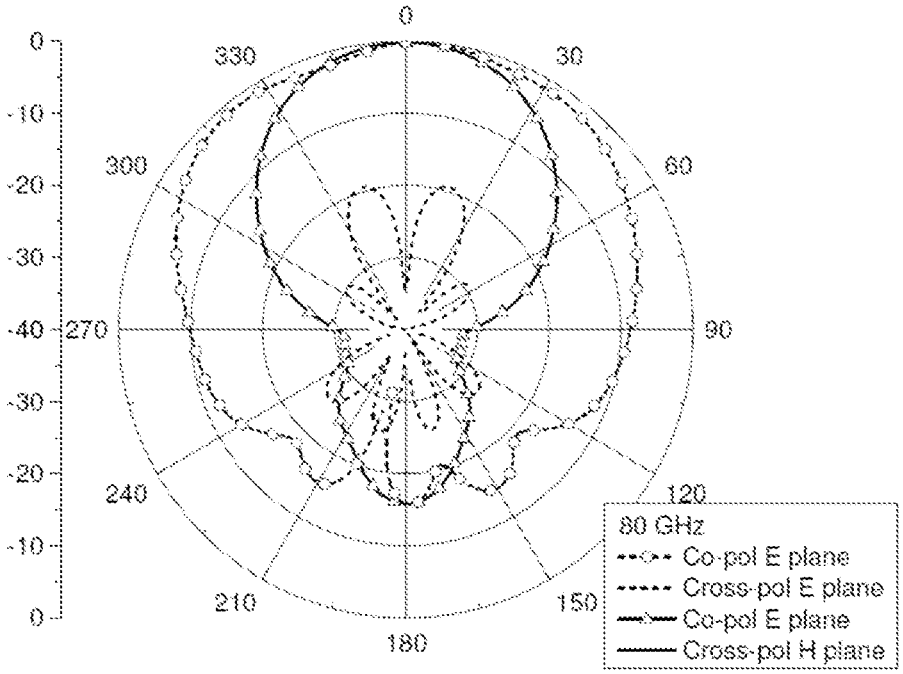

The radiation patterns at 60 GHz, 70 GHz and 80 GHz are depicted in FIGS. 3(*a*)-(*c*), respectively. It can be seen that the antenna achieves stable radiation patterns in the broadside direction within the entire operation frequency band. The cross-polarization levels of the antenna are lower than −20 dB, which means low cross-polarization levels are achieved.

Advantages/Industrial Applicability

The antenna of the present invention has the advantages of high gain, wide gain bandwidth, simple structure, and low processing cost. Its wide gain bandwidth can be applied to different communication application frequency bands, and it is attractive for use in indoor and outdoor base station antennas in modern cellular communication systems. In addition, the proposed antenna has a single-layer structure and can be fabricated by low-cost PCB technology which is convenient to apply to different regions of the millimeter wave frequency band. Further, the antenna is susceptible to IC design processes or LTCC (low-temperature co-fired ceramic) processing.

Figure 4:
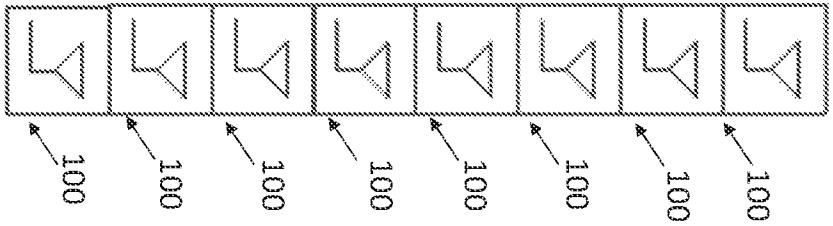
FIG. 4 shows an array of the antennas of FIG. 1*a*.

The antenna can be used as an element in a single-layer high-gain linear array (see FIG. 4 which shows an array of the antennas 100 of FIG. 1*a*) in the millimeter wave band, and due to the high gain of each single antenna, the number of antenna elements used can be decreased, and thus the array design can be simplified.

One main feature of the present invention is high antenna gain. Advantageously, the open-aperture waveguide fed slot antenna has a peak gain of 8.7 dBi. The high loss in the millimeter wave spectrum will seriously affect communication distance and communication quality. Using the inventive high gain slot antenna can compensate the energy loss in the transmission path of millimeter wave, which can improve the signal quality and transmission distance for a wireless communication system. The antenna may be used as a base station antenna for high gain antenna array design to reduce the number of array units and simplify array complexity. These makes the present invention suitable for point-to-point communications, wireless power transfer, radar systems, particularly for the 5th generation wireless systems (5G).

Another feature of the present invention is the wide gain bandwidth, which can cover many different frequency bands. The sufficiently-wide bandwidth makes the antenna suitable to be applied in wideband communication systems such as 5th generation wireless systems (5G) and Internet of Things (IoT), which requires high transmission speed.

It can be understood in the claims and the description that the terms "lateral", "longitudinal" and "vertical" are used for convenient and clear description. The use of these and similar terms is not considered to be any limitation of using the antenna direction.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. An antenna comprising:

a feeding section defined on a substrate integrated waveguide, wherein the feeding section includes a slot structure at one end, the slot structure being filled with a material different from that of the substrate integrated waveguide;

a matching end adjacent to the slot structure; and a bottom metal sheet disposed on a bottom surface of the substrate integrated waveguide;

wherein the slot structure includes a center section having two sides connected to two end sections at opposite ends of the center section, thereby defining an H-shaped slot; wherein the center section and the matching end have a same width along a lateral axis of the substrate integrated waveguide.

2. The antenna in accordance with claim 1, wherein the slot structure is filled with air or a dielectric material.

3. The antenna in accordance with claim 1, further comprising an excitation section defined on the substrate integrated waveguide; wherein the matching end and the slot structure are arranged along a longitudinal axis; and wherein the excitation section is a portion of the feeding section away from the H-shaped slot.

4. The antenna in accordance with claim 3, wherein the excitation section is at least partially bound by a plurality of vias arranged along the longitudinal axis and away from the H-shaped slot.

5. The antenna in accordance with claim 1, further comprising a top metal sheet disposed on a top surface of the substrate integrated waveguide, wherein one of the two sides of the center section connects the top metal sheet, and another one of the two sides of the center section connects to the matching end.

6. The antenna in accordance with claim 1, further comprising a metallic via wall including a plurality of vias connecting top and bottom surfaces of the substrate integrated waveguide, and including a top metal sheet, wherein the metallic via wall has the same width as that of the center section of the H-shaped slot, a height of the metallic via wall is equal to that of the feeding section along a vertical axis of the substrate integrated waveguide, and wherein the metallic via wall and the top and bottom metal sheets are connected by the metallic via wall which forms the matching end.

7. The antenna in accordance with claim 1, wherein the bottom metal sheet includes a square metallic patch covering a bottom part of the antenna, and covers a bottom of the feeding section in both the longitudinal axis and the lateral axis.

8. The antenna in accordance with claim 1, wherein the substrate integrated waveguide includes a single layer of dielectric substrate.

9. An antenna array comprising a plurality of antennas in accordance with claim 1, wherein the plurality of antennas is arranged as a single layer high-gain linear array operable in a millimeter-wave frequency band.

* * * * *